United States Patent [19]

Ragland, Jr.

[11] Patent Number: 4,460,843

[45] Date of Patent: Jul. 17, 1984

[54] COLOR PICTURE TUBE HAVING IMPROVED TEMPERATURE COMPENSATING SUPPORT FOR A MASK-FRAME ASSEMBLY

[75] Inventor: Frank R. Ragland, Jr., Lancaster, Pa.

[73] Assignee: RCA Corporation, New York, N.Y.

[21] Appl. No.: 373,051

[22] Filed: Apr. 29, 1982

[51] Int. Cl.[3] ..... H01J 29/07

[52] U.S. Cl. ..... 313/406; 313/407

[58] Field of Search ..... 313/406, 407, 404

[56] References Cited

U.S. PATENT DOCUMENTS

| | | | |
|---|---|---|---|
| 2,795,718 | 6/1957 | van Hekken et al. | 313/404 |
| 2,795,719 | 6/1957 | Morrell | 313/404 |
| 3,308,327 | 3/1967 | Shrader | 313/406 |
| 3,370,194 | 2/1968 | Schwartz et al. | 313/404 |
| 3,487,251 | 12/1969 | Barten et al. | 313/406 |
| 3,492,522 | 1/1970 | Pappadis | 313/406 |
| 3,529,199 | 9/1970 | Duistermaat et al. | 313/404 |
| 3,803,436 | 4/1974 | Morrell | 313/406 X |
| 3,832,592 | 8/1974 | Yamazaki | 313/404 |
| 3,943,399 | 3/1976 | Sedivy | 313/404 |

*Primary Examiner*—Palmer C. Demeo

*Attorney, Agent, or Firm*—Eugene M. Whitacre; Dennis H. Irlbeck

[57] ABSTRACT

An improved color picture tube according to the invention includes an evacuated envelope enclosing a mask attached to a frame, which is suspended in relation to a cathodoluminescent screen by novel support means. The tube also includes an electron gun for forming a plurality of electron beams and directing the beams through the mask to the screen. The novel support means includes a plurality of springs each having an aperture engaged with a stud which is embedded in the envelope. Each of the springs is attached to the frame and has a resilient portion between the aperture and each location of attachment. The resilient portion is inclined relative to the longitudinal axis of the tube, and a plane containing a major surface of the resilient portion approximately parallels one of the perpendicular screen axes.

4 Claims, 15 Drawing Figures

COLOR PICTURE TUBE HAVING IMPROVED TEMPERATURE COMPENSATING SUPPORT FOR A MASK-FRAME ASSEMBLY

BACKGROUND OF THE INVENTION

This invention relates to color picture tubes of the type having a mask attached to a frame which is suspended in relation to a cathodoluminescent screen, and particularly to a temperature compensating support for suspending the mask-frame assembly within the tube.

In these color picture tubes, the accuracy with which the electron beams strike the individual elemental cathodoluminescent screen areas depends, to a great extent, upon the accuracy with which the mask apertures are aligned with the elemental screen areas during operation of the tube. Thus, as the mask expands by reason of thermal effects occasioned by the impact thereon of the electron beams, the resulting misalignment of the mask apertures and elemental screen areas causes a portion of the electron beams to impinge upon elemental screen areas other than the ones upon which they were intended to impinge.

Several methods or means have been proposed to compensate for thermal expansion of the mask by causing the mask to move toward the screen as it expands outwardly, to maintain the desired alignment of the mask apertures and elemental screen areas. One early approach disclosed in U.S. Pat. No. 2,795,719, issued to Morrell on June 11, 1957, proposed moveably mounting the mask within the envelope by means of three carriages attached to the periphery of the mask and sliding on inclined tracks mounted on the envelope. Another early approach disclosed in U.S. Pat. No. 2,795,718, issued to van Hekken et al. on June 11, 1957, proposed the use of a multiplicity of flexible hinges connecting the masking member with a supporting frame, or a pivoted bell crank having arms slidably engaging the mask. These compensating means were designed primarily for use with circular masks in round tubes of moderate size and moderate deflection angle.

Most present day color picture tubes utilize a bimetallic mask mounting assembly such as described in U.S. Pat. No. 3,803,436, issued to Morrell on Apr. 9, 1974. In this patent, a bimetallic element is connected between a stud embedded in the faceplate panel and the mask electrode. The bimetallic element may be a spring welded directly to the frame or an intermediate member located between the spring and frame.

Although the bimetallic elements have served well for their intended purpose, their additional cost is relatively high. Therefore, there is a need for further development of thermal compensating mask supports which do not utilize bimetallic elements and which are not mechanically complex.

SUMMARY OF THE INVENTION

An improved color picture tube according to the invention includes an evacuated envelope enclosing a mask attached to a frame which is suspended in relation to a cathodoluminescent screen by novel support means. The tube also includes an electron gun for forming a plurality of electron beams and directing the beams through the mask to the screen. An axis passing through the center of the electron gun and the center of the screen is defined as the longitudinal axis of the tube. The screen includes two screen axes, a major axis and a minor axis, which are perpendicular to each other and perpendicular to the longitudinal axis. The novel support means includes a plurality of springs, each having an aperture engaged with a stud which is embedded in the envelope. Each of the springs is attached to the frame and has a resilient portion between the aperture and location of attachment. The resilient portion is inclined relative to the longitudinal axis of the tube, and a plane containing a major surface of the resilient portion approximately parallels one of the screen axes.

DETAILED DESCRIPTION

Figure 1:
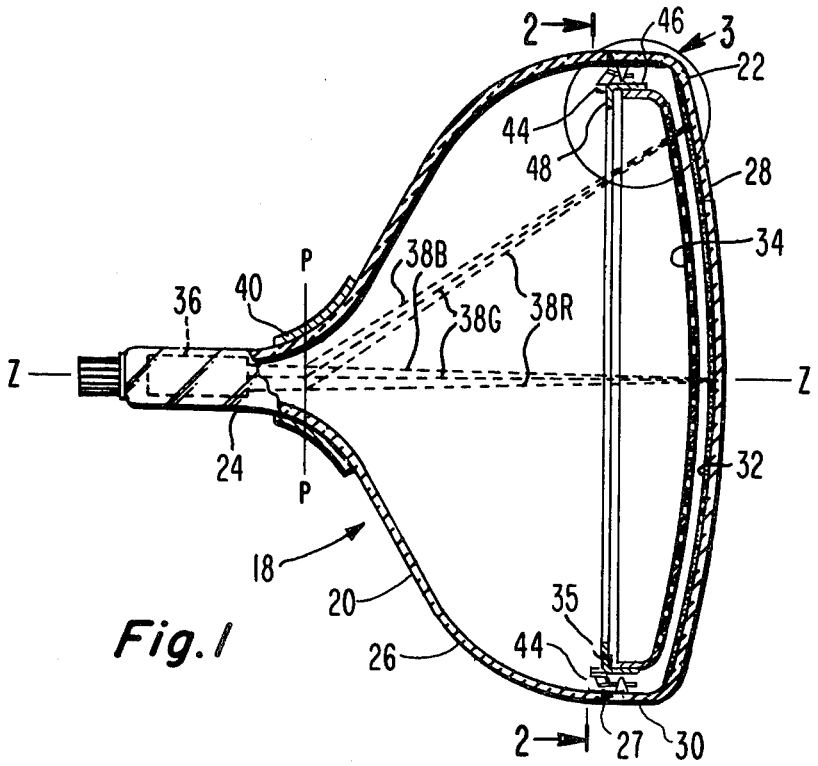
FIG. 1 is a plan view in axial section of an apertured mask cathode-ray tube.

FIG. 1 illustrates a rectangular color picture tube 18 having a evacuated glass envelope 20 comprising a faceplate panel 22 and a tubular neck 24 joined by a funnel 26. The panel 22 comprises a viewing faceplate 28 and a peripheral flange or sidewall 30, which is sealed to the funnel 26 by a frit material 27. A mosaic three-color cathodoluminescent line screen 32 is located on the inner surface of the faceplate 28. The screen 32 comprises an array of phosphor lines extending substantially parallel to the vertical or minor axis thereof. Portions of the screen 32 may be covered with a light-absorbing material in a manner known in the art. A multiapertured color selection electrode or shadow mask 34, attached to a frame 35 having an L-shaped cross-section, is removeably mounted within the panel 22 in predetermined space relationship to the screen 32. A novel support for this mask-frame assembly is described in detail below. The mask 34 includes a multiplicity of slit-shaped apertures, which are aligned in substantially parallel vertical columns, and web portions separating the slits of each column.

An inline electron gun 36 (illustrated schematically) is mounted within the neck 24 to generate and direct three electron beams 38B, 38R and 38G along coplanar convergent paths through the mask 34 to the screen 32.

The tube 18 is designed to be used with an external magnetic deflection yoke 40 surrounding the neck 24 and funnel 26 in the vicinity of their junction. When appropriate voltages are applied to the yoke 40, the three beams 38B, 38R and 38G are subjected to vertical and horizontal magnetic fields that cause the beams to scan horizontally, in the direction of the major screen axis, and vertically, in the direction of the minor screen axis, in a rectangular raster over the screen 32. For simplicity, the actual curvature of the paths of the deflected beams in the deflection zone is not shown in FIG. 1. Instead, the beams are schematically shown as having an instantaneous bend at the plane of deflection P-P.

Figure 2:
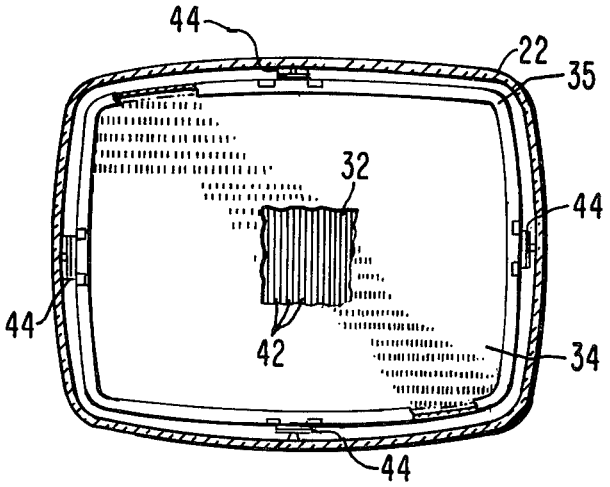
FIG. 2 is a back view of the faceplate and mask-frame assembly of the tube of FIG. 1.

A portion of the screen 32, partially covered by the mask 34, is illustrated in FIG. 2. The screen 32 comprises alternate lines 42 of red-, green- and blue-emitting phosphor elements. Also shown in FIG. 2 are four mask-frame supports 44 (two of which are shown in FIG. 1) that suspend the assembly of the mask 34 and frame 35 within the panel 22. Although four supports 44 are used in this embodiment, other embodiments could use, for example, three. FIGS. 3 through 12 show the mask-frame supports 44 and associated portion of the frame 35 in greater detail.

Figure 3:
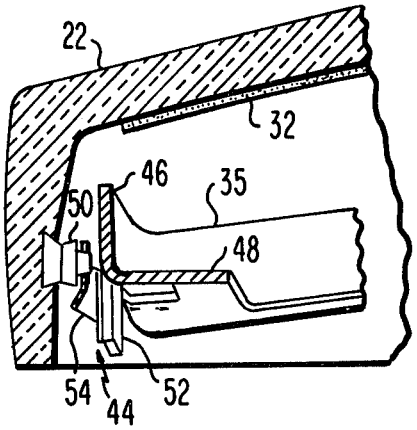
FIG. 3 is an enlarged view of the circled portion, designated 3, of the tube of FIG. 1 without a shadow mask.
Figure 4:
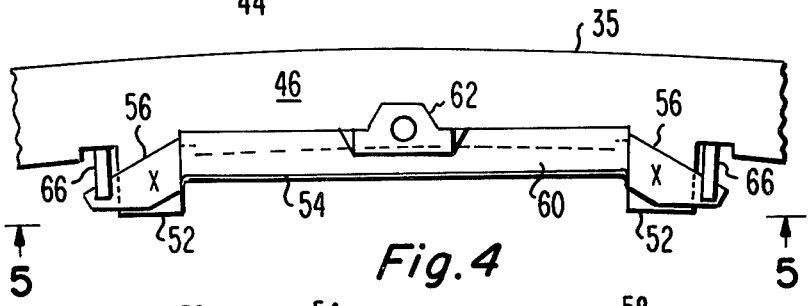
FIG. 4 is a side view of the novel support means of the tube of FIG. 1.
Figure 5:
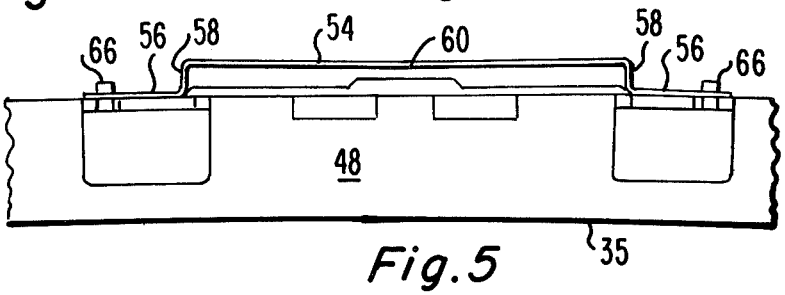
FIG. 5 is a back view of the novel support means taken at line 5—5 of FIG. 4.
Figure 6:
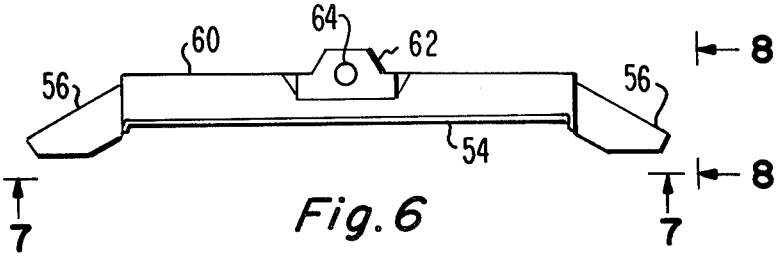
FIG. 6 is a side view of a bow spring included in the novel support means.
Figure 7:
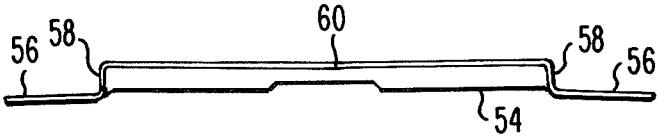
FIG. 7 is a back view of the bow spring taken at line 7—7 of FIG. 6.
Figure 8:
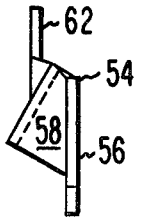
FIG. 8 is an end view of the bow spring taken at line 8—8 of FIG. 6.
Figure 11:
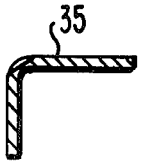
FIG. 11 is a cross-sectional view of the frame taken at line 11—11 of FIG. 10.
Figure 12:
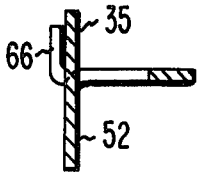
FIG. 12 is a cross-sectional view of the frame taken at line 12—12 of FIG. 10.
Figure 9:
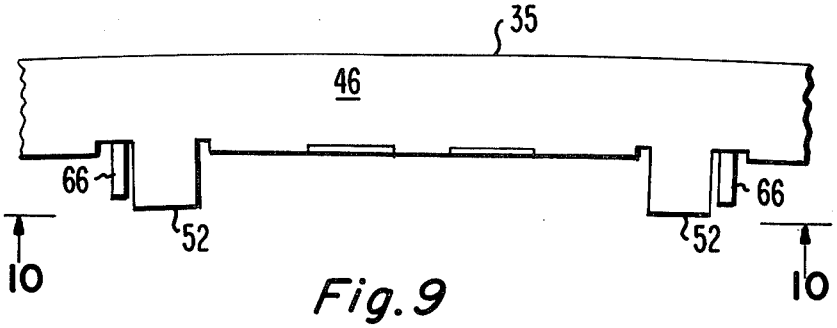
FIG. 9 is a partial side view of the frame used with the bow spring of FIG. 6.
Figure 10:
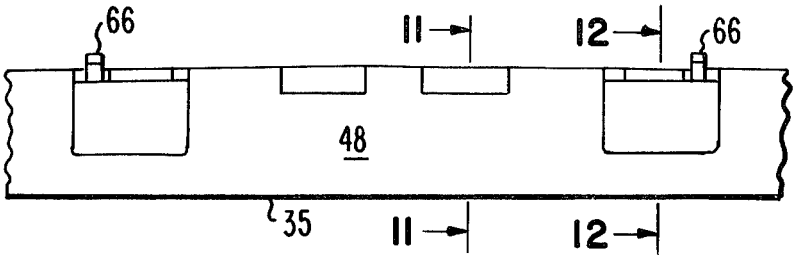
FIG. 10 is a partial back view of the frame taken at line 10—10 of FIG. 9.

The frame 35 has an L-shaped cross-section with a first flange 46 extending toward the screen 32 and a second flange 48 extending toward the longitudinal axis Z—Z of the tube 18, as shown in FIG. 3. Each mask-frame support 44 includes three components; a stud 50 embedded into the sidewall 30 of the panel 22, two tabs 52 extending from the frame 35, and a bow spring 54. The bow spring 54 includes two end portions 56 which are welded to the two tabs 52 at the points marked X on FIG. 4. Two flexible step risers 58 extend substantially perpendicularly from the end portions 56. The two step risers 58 are connected by an elongated resilient portion 60, which is inclined with respect to the longitudinal axis Z—Z of the tube 18 and which has a major surface approximately paralleling one of the screen axes. The elongated portion 60 has a central portion 62 which is angled with respect to the elongated portion 60 so that it parallels the end portions 56. The central portion 62 includes a centered aperture 64 which is engaged on the stud 50. The frame 35 also includes two hooks 66 located adjacent each tab 52 which hold the bow spring 54 against the tabs 52 prior to welding the springs 54 to the tabs 52.

When the frame 35 expands during tube operation, the two end portions 56 of the spring 54 are forced to move outwardly toward the stud 50. This motion causes the elongated resilient portion 60 to bow, and the two step risers 58 to flex inward slightly to accommodate the bowing action. Because the elongated portion 60 is inclined with respect to the longitudinal axis Z—Z, the outward movement of the spring end portions 56 also translates into a motion of the end portions 56 and the frame 35 toward the tube screen 32. The angle of the elongated resilient portion 60 with respect to the longitudinal axis Z—Z is selected to assure that the alignment of the mask apertures with the phosphor elements of the screen, along the electron beam paths, remain unchanged despite mask expansion. For example, in a typical 21 V tube, the appropriate angle of inclination is 40 degrees. Generally, it has been found that the resilient elongated portion 60 should be 10 to 15 times longer than the spacing between the frame 35 and the stud 50, in order to have a proper flexing action.

Figure 13:
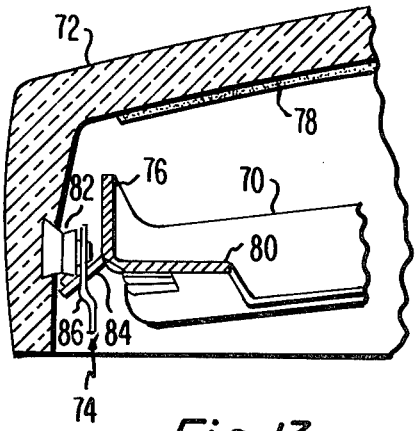
FIG. 13 is a plan view of a tube faceplate having another embodiment of a novel support means for suspending a frame therein.
Figure 14:
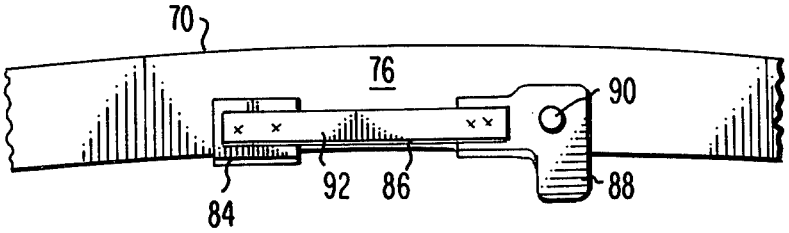
FIG. 14 is a side view of the novel support means of FIG. 13.
Figure 15:
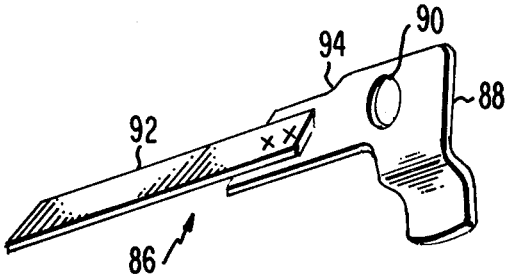
FIG. 15 is a perspective view of a cantilever spring included in the novel support means of FIG. 13.

An alternate embodiment of the present invention is shown in FIGS. 13, 14 and 15. A frame 70 is mounted within a tube faceplate panel 72 by a mask-frame support 74 as shown in FIG. 13. The frame 70 has an L-shaped cross section, with a first flange 76 extending toward a screen 78 on the faceplate panel 72 and a second flange 80 extending toward the longitudinal axis of the tube. The mask-frame support 74 includes three components; a stud 82 embedded into the sidewall of the faceplate panel 72, a tab 84 extending from the frame 70 toward the stud 82, and a cantilevered leaf spring 86. The leaf spring 86 includes an end portion 88 having an aperture 90 therein, and a resilient elongated portion 92 attached at one end to the end portion 88 and at the other end to the frame tab 84. The tab 84 and the elongated portion 92 are inclined relative to a longitudinal axis of a tube. The elongated portion 92 also approximately parallels either the major or minor screen axis. There is a twist 94 in the end portion 88 so that the plane of the aperture 90 substantially parallels the tube longitudinal axis. The angle of inclination of both the tab 84 and the elongated portion 92 is about 45 degrees for a typical 21 V tube.

The function of the leaf spring 86 is similar to that of the bow spring 54. As the frame 70 expands during tube operation, the inclined elongated portion 92 of the spring 86 causes the frame 70 to move toward the screen 78 thus keeping mask apertures aligned with phosphor elements of the screen along the electron beam paths.

Utilization of a tab or tabs extending from the frame in each of the foregoing embodiments permits simplified spring designs which are easy and inexpensive to construct. Alternatively, the tabs could be portions of the springs which are attached to the frame. The angle of inclination of the elongated resilient portion 60 of the bow spring 54 or of the elongated resilient portion 92 of the leaf spring 86, with respect to the longitudinal axis Z—Z, is dependent on the amount of mask movement required to maintain electron beam register for a particular tube. Because of the many variables in tubes, such as different mask and frame materials, different internal components attached to the mask, and different mask radiation characteristics, some experimentation is required to obtain the proper angle of inclination for a particular tube. In the preferred embodiment utilizing the bow spring 54, the bow spring 54 for the 21 V tube was constructed of S44511 0.734 mm-thick stainless steel, and the elongated resilient portion 60 was 10.16 cm long.

Although the preferred embodiments are described herein with respect to a line-screen, slit-aperture-mask type color picture tube, the invention is equally applicable to other types of color picture tubes such as dot-screen, circular-aperture type tubes or tubes having other type screens combined with other type mask electrodes.

It should also be understood that the novel mask-frame supports may be used with a tube wherein the frame is an integral portion of the mask, such as may be formed by suitable bending of the mask skirt. Furthermore, although the novel support embodiments described herein will cause the mask to be moved toward the screen when the support is heated, the supports can be used to move the mask away from the screen as the supports are heated by altering the direction of the tabs and by inverting the positions of the springs.

What is claimed is:

1. In a color picture tube of the type including an evacuated envelope enclosing a cathodoluminescent screen, an electron gun and an apertured mask attached to a frame which is suspended in relation to said screen by support means, an axis passing through the center of said electron gun and the center of said screen being the longitudinal axis of said tube, said screen also including a major axis and a minor axis which are perpendicular to each other and perpendicular to said longitudinal axis, said support means including a plurality of studs embedded in said envelope and spaced around said frame, and a plurality of springs, each having an aperture engaged with one of said studs, and each being attached to said frame, at least one of said springs being a bow spring, said bow spring including two end portions which are attached to said frame, two flexible step risers extending substantially perpendicularly from said end portions, and an elongated resilient portion extending between said step risers, said resilient portion being inclined with respect to said longitudinal axis and approximately paralleling one of said major and minor axes, said resilient portion including a centrally located aperture in engagement with one of said studs, and said step risers being flexible to accommodate bowing of said elongated resilient portion.

2. The tube as defined in claim 1 wherein said frame includes a plurality of tabs extending away from said frame and said springs are attached to said tabs.

3. The tube as defined in claim 2 wherein said frame includes a first flange extending substantially parallel to said longitudinal axis and a second flange extending substantially perpendicular to said longitudinal axis, and said tabs are essentially integral portions of said second flange which are bent away from said second flange and substantially parallel to said first flange.

4. The tube as defined in claim 1 wherein said frame includes an integral hook portion engaging an end of one of said springs.

* * * * *